United States Patent [19]

Wakefield

[11] 4,429,476

[45] Feb. 7, 1984

[54] SELF-IMMERSING JET PUMP

[76] Inventor: Anthony W. Wakefield, Wakefield House, Stamford, Lincolnshire, PE9 1BE, England

[21] Appl. No.: 271,214

[22] Filed: Jun. 8, 1981

[30] Foreign Application Priority Data

Jun. 9, 1980 [ZA] South Africa ..... 80/3430

[51] Int. Cl.[3] ..... E02F 3/88

[52] U.S. Cl. ..... 37/62; 37/72

[58] Field of Search ..... 37/61, 62, 63, 72; 114/293

[56] References Cited

U.S. PATENT DOCUMENTS

| | | | |
|---|---|---|---|
| 908,113 | 12/1908 | Lovett | 37/62 |
| 2,599,980 | 6/1952 | Dunning | 37/62 |
| 2,711,598 | 6/1955 | Craggs, Jr. | 37/62 |
| 3,153,290 | 10/1964 | Saito | 37/62 |
| 3,992,735 | 11/1976 | McCarthy | 37/72 X |
| 4,217,709 | 8/1980 | Casciano | 37/62 |

FOREIGN PATENT DOCUMENTS

| | | | |
|---|---|---|---|
| 234395 | 5/1960 | Australia | 37/63 |
| 273329 | 5/1951 | Switzerland | 37/63 |
| 606953 | 5/1978 | U.S.S.R. | 37/62 |

*Primary Examiner*—Clifford D. Crowder

[57] ABSTRACT

A jet pump which is used in dredging situations and includes a series of water nozzles which create a slurry in a sand mass by erosion thereof, the slurry being conveyed to a receiving station.

7 Claims, 4 Drawing Figures

FIG_2
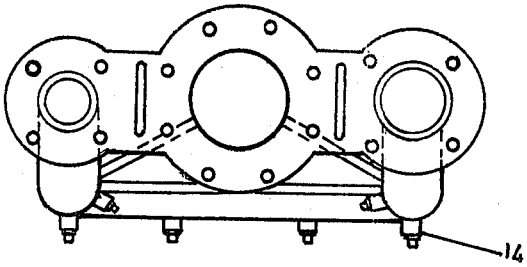
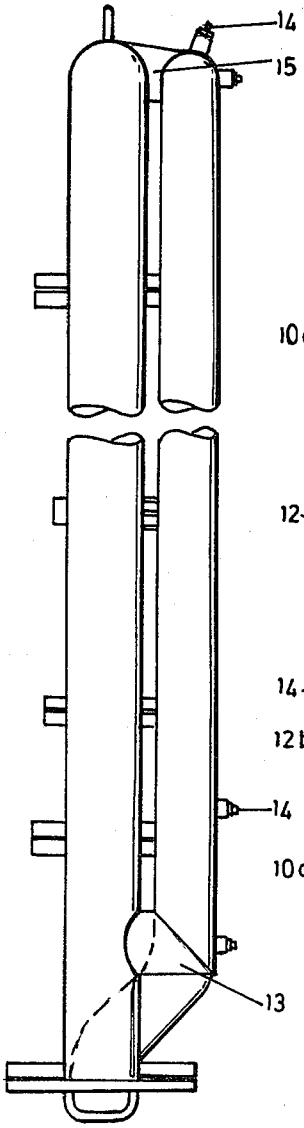
FIG_3
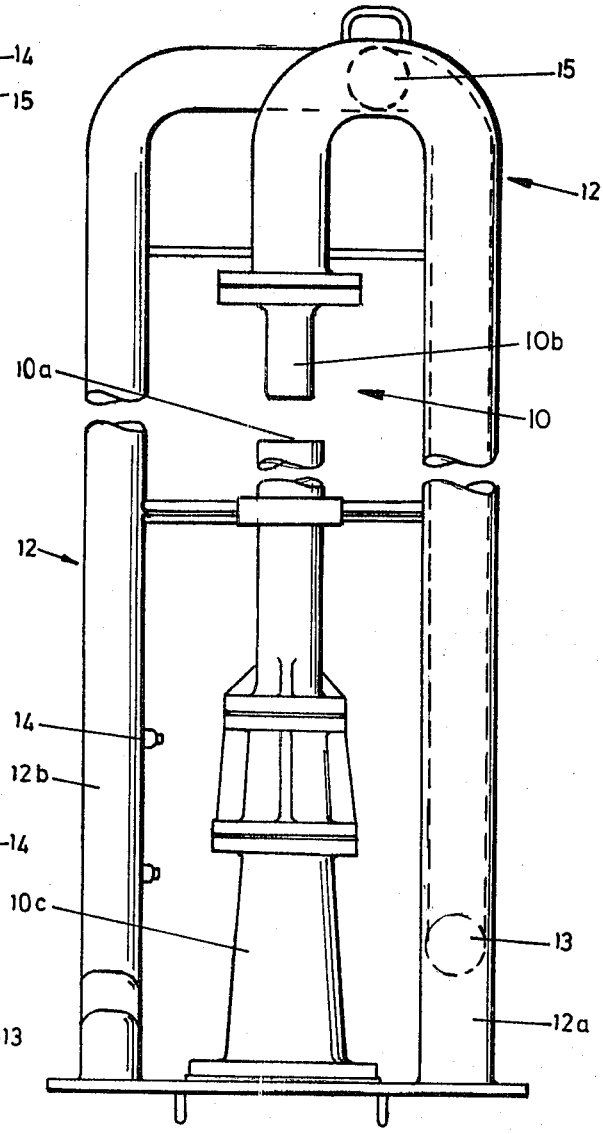
FIG_1

SELF-IMMERSING JET PUMP

This invention relates to a self-immersing jet pump which is particularly useful in dredging situations but may also be used for prospecting or sampling.

A central jet type of jet pump has advantages in dredging owing to the nature of its characteristic curve, to the fact that it can operate immersed in the deposit, and to its inherent resistance to abrasion.

In a conventional arrangement the jet pump is attached to the lower end of a dredging ladder comprising essentially one conduit conveying motive water down to the jet pump and a second conduit conveying slurry back up to the surface. In addition, there may be structural members, a rotating mechanical cutterhead and shaft or water jets and pipework for disintegration of bottom material to render it pumpable. The motive pump, prime mover, raising and dredge location winches, and so on, are usually supported on a bulk or catamaran pontoon.

It is an object of the present invention to provide a system which permits a jet pump to operate in an immersed position without the necessity of some or all of the other items mentioned above, and particularly the need for floating equipment.

According to the invention a jet pump includes a structure adapted to receive water, the structure including nozzles or the like whereby the water passing through the nozzles causes erosion of the material surrounding a jet pump, thereby allowing the jet pump to sink in the material.

In a simple form of the invention, a pipe surrounds the jet pump, the pipe being attached to a supply of water and having a series of fluidisation nozzles arranged around the pipe. The nozzles may be at right angles or transverse to the axis of the jet pump, or along or parallel to the axis. The particular arrangement, or the combination of arrangements, chosen depending on the angle at which it is desired that the jet pump enter the material.

The nozzles will have the effect of fluidising a sand deposit or whatever material is being pumped.

As mentioned above, the nozzles may be arranged in two ways:

(i) The jet pump may be laid horizontally on the deposit. Jets beneath it, that is at right angles or transverse to the axis of the jet pump cut away and fluidise the bed allowing the jet pump to sink into it, initially in the horizontal position but this could become progressively inclining towards the vertical owing to the impeding effect of the motive supply and slurry hoses. The hoses may be fed into the ground after the jet pump. When the pump is at the desired depth, the disintegration or fluidising jets could be turned off, thereby preventing further penetration of the jet pump.

(ii) The jet pump may be lowered vertically from some form of suspension tackle. Jets beneath it, that are aligned with or slightly inclined to the axis of the jet pump, cut away and fluidise the bed, allowing the jet pump to sink into it, as before except that in this case the jet pump axis is always vertical.

The pump might be lowered through a pipe which might be assembled in sections to form a continuous casing. The pump would then extract all material ahead of and within the casing, allowing penetration of the casing, and deliver the excavated material to the surface. In this application, the pump could be used as a high output prospecting or sampling tool.

According further to the invention a cylindrical float is provided for use with the jet pump arrangement described above, for circumstances in which the material being pumped is below a body of water. The cylindrical float supports the hoses to and from the jet pump and may be connected to winches from its axle.

The hoses to and from the jet pump would be led over the float and horizontally, or via a catenary or downwards and across the bottom, to shore. The load in the hoses would resolve into downward and horizontal forces supplied to the drum. The drum would have sufficient buoyancy to overcome the former, and sufficient radius to accommodate the tolerance of the hoses to flexing. The latter force would be countered by means of a cable attached to an axle through, or stub axles attached to the ends of the drum and leading in the direction opposite to the hoses to an anchorage. This anchorage might be a winch on the opposite shore, regulation of which would allow variation of dredging position. A typical application would be sand dredging in a river, or de-silting behind a dam.

Embodiments of the invention are described below with reference to the accompanying drawings, in which FIG. 1 is a plan view of a sand dredging jet pump arrangement according to the invention;

FIG. 2 is an end view on FIG. 1;

FIG. 3 is a side view on FIG. 1; and

Figure 4:
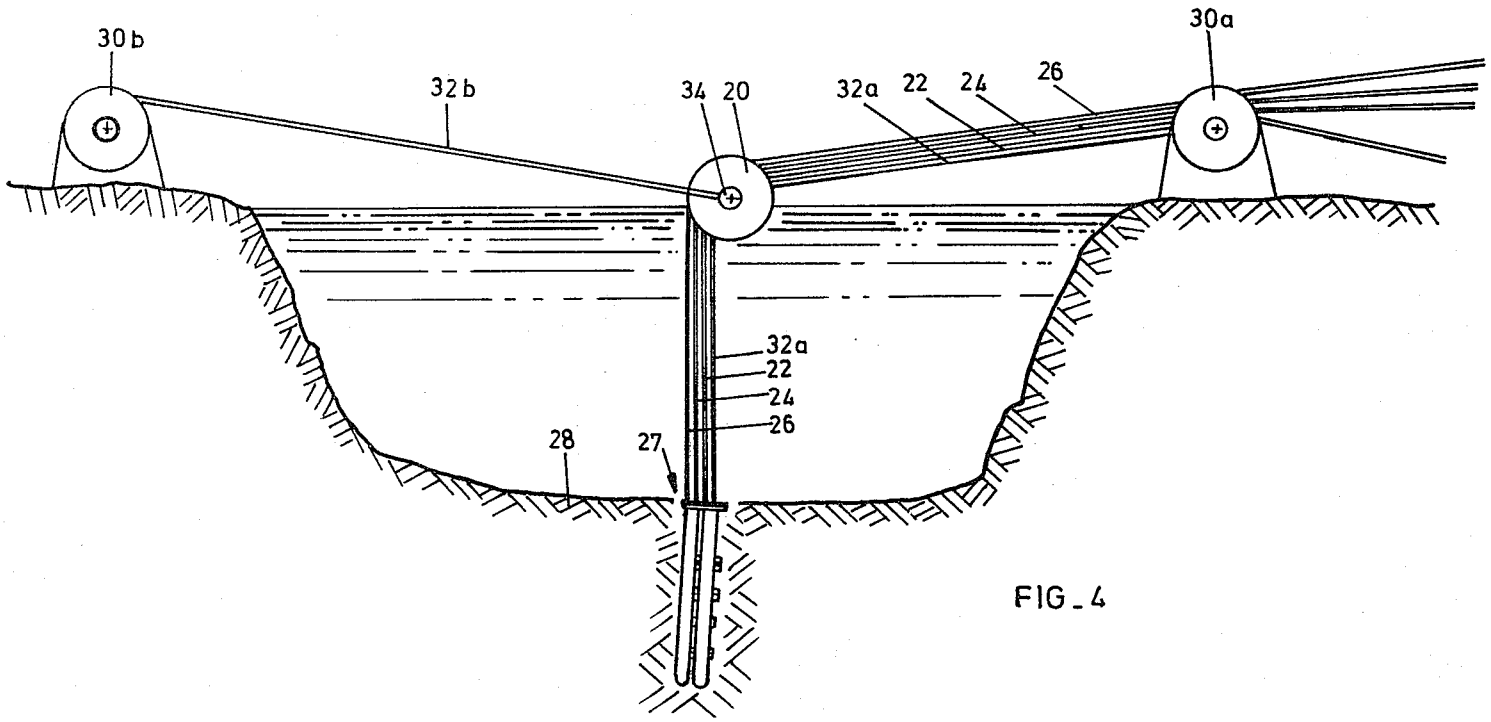
FIG. 4 is a diagram of the pump in use.

In the drawings, a jet pump 10 is surrounded by a water pipe 12 to which it is firmly attached by suitable struts and the like. The pipe 12 has a series of nozzles 14 which may be at fixed angles thereto, or the angles may be variable. Alternatively, there may be a plurality of nozzles in each of several direction depending, of course, on the application of the pump, the nozzles determing the angle and rate of penetration of the pump unit into the sand deposit as well as the amount of agitation of the sand particles in the immediate vicinity of the pump intake 10*a*. This, in turn, will depend on the desired solids to liquid ratio of the particular application of the pump.

The surrounding pipe 12 is constituted by a motive fluid pipe 12*a* which is connected to a pump on the surface, and a fluidising fluid pipe 12*b*, also connected to a pump on the surface. The fluidising fluid pipe 12*b* encircles the pump 10 and is attached at 13 and 15 to the motive fluid pipe 12*a*.

The pump 10 comprises a jet nozzle 10*b* arranged to eject motive fluid under pressure across a gap between the nozzle 10*b* and the intake or throat 10*a*, entraining surrounding sand and water in the process and creating a suction in the widening suction branch 10*c* of the pump 10. The entrained material is then drawn into the discharge branch 10*c* and pumped to the surface.

The motive and fluidising fluids as well as the pumped material is conveyed to and from the surface by means of an arrangement of pipes and a float, which arrangement is shown in FIG. 4.

The float 20 supports the pipes 22, 24 and 26 of the jet pump arrangement 27 in the bed of a river 28. Winches 30 may be provided on the banks of the river to wind in or pay out cable 32 attached to the axle of the float 20 and the pump unit.

Two high pressure water pipes are provided, the pipe 22 carrying motive fluid and the pipe 24 carrying the water supply for the fluidising or disintegrating jets or nozzles 14. The third pipe 26 conveys the pumped material to the surface.

The float 20 supports the pipes only, and the crosswise drift of the float is prevented by a restraining cable 32*b* attached to the winch 30*b* and the axle 34 of the float 20. The pump unit 27 can be removed from the river bed 28 by the cable 32*a* attached to the winch 30*a* on the other bank of the river. As can be seen in the drawing the unit 27 is preferably sunk vertically into the river bed and weight thereof is not supported by the float 20 which merely supports the weight of the pipes. The pipes are conveniently wound onto the winch 30*a* but it will be appreciated that they carry no strain, this being carried by the cable 32*a*. The unit can be moved across the bed by being lifted from the bed with the cable *32a* whereafter the position of the float 20 is adjusted relatively to the bed by means of the cable 32*b*.

I claim:

1. A dredging apparatus for dredging material from a deposit, said apparatus comprising a jet pump, a float, a winch, adapted to be mounted on land adjacent to the material to be dredged, a cable connecting the winch to said float, for controlling the position of said float, and a plurality of hoses originating at a location remote from said float, said jet pump including means for receiving and for discharging fluid and including nozzles through which said fluid will be discharged to erode material surrounding said jet pump, said float comprising a body with means for supporting said hoses wherein said hoses are adapted to convey fluid to and from said jet pump respectively, and wherein said floating body has a curved surface with a radius of curvature sufficient to accommodate flexure of said hoses and has a buoyancy sufficient to overcome the downward drag of said hoses.

2. The dredging apparatus of claim 1, wherein said pump includes at least a first pipe and a second pipe for receiving fluid under pressure, said first pipe having a plurality of apertures for discharging said fluid to erode deposit material around said first pipe during use of said jet pump, said second pipe including at least an outlet aligned with a throat in order to form a venturi for entraining eroded material.

3. The dredging apparatus according to claim 2 wherein each of said apertures in said first pipe comprises a nozzle, said nozzles being arranged to at least partially surround said outlet such that materials dislodged by fluid emitted from said nozzles is entrained with fluids from said second pipe directed to said throat.

4. Dredging apparatus according to claim 1, wherein said floating body is cylindrical.

5. The dredging apparatus of claim 1 wherein said pump comprises:

a first section with an outlet for discharging fluid under pressure into said deposit to erode and entrain material within said deposit;

a second section having an inlet for receiving fluid discharged from said outlet and eroded material from said deposit, said inlet being spaced from said outlet in the direction in which said fluidized material is discharged, and in generally vertical alignment with said outlet.

6. The dredging apparatus of claim 5 wherein said inlet further includes a widening portion adapted to receive fluid under pressure from said outlet, so as to produce a suction in said widening portion to pull said fluid and deposit material therethrough.

7. The dredging apparatus of claim 5 further including a pipe attached to said inlet for conveying said deposit material and fluid away from said jet pump.

* * * * *

UNITED STATES PATENT AND TRADEMARK OFFICE

CERTIFICATE OF CORRECTION

PATENT NO. : 4,429,476

DATED : February 7, 1984

INVENTOR(S) : Anthony W. WAKEFIELD

It is certified that error appears in the above-identified patent and that said Letters Patent is hereby corrected as shown below:

On the front page, the Assignee should be listed as ---General Conveyors Limited, Lincolnshire, England.---

On the front page, the firm should be listed as ---Sandler & Greenblum---.

Signed and Sealed this

*Twenty-seventh* Day of *November 1984*

[SEAL]

*Attest:*

GERALD J. MOSSINGHOFF

*Attesting Officer*

*Commissioner of Patents and Trademarks*